US005921022A

United States Patent [19]

Baker

[11] Patent Number: 5,921,022

[45] Date of Patent: Jul. 13, 1999

[54] ROTATING TREE STAND SYSTEM

[76] Inventor: John A Baker, 16602 Townes Rd., Friendswood, Tex. 77546

[21] Appl. No.: 08/873,903

[22] Filed: Jun. 12, 1997

Related U.S. Application Data

[51] Int. Cl.[6] ..... A01G 7/02; A01G 7/00; A01G 31/02

[52] U.S. Cl. ..... 47/40.5; 47/39; 47/65

[58] Field of Search ..... 47/39, 40.5, 65

[56] References Cited

U.S. PATENT DOCUMENTS

| | | | |
|---|---|---|---|
| 626,514 | 6/1899 | Wagner | 47/39 |
| 1,468,247 | 9/1923 | Patten | 47/39 |
| 1,575,988 | 3/1926 | Gleerup-Moller | 47/39 |
| 1,943,659 | 1/1934 | Eason | 47/40.5 |
| 2,005,293 | 6/1935 | Harris et al. | 47/40.5 |
| 2,058,677 | 10/1936 | Fritz | 47/40.5 |
| 2,416,802 | 3/1947 | Roung | 47/40.5 |
| 2,587,788 | 3/1952 | Tacy | 47/40.5 |
| 2,674,147 | 4/1954 | Franklin | 47/40.5 |
| 2,847,175 | 8/1958 | Farley et al. | 47/40.5 |
| 2,874,496 | 2/1959 | Rakes | 47/40.5 |
| 3,042,350 | 7/1962 | Lencioni | 47/40.5 |
| 4,099,824 | 7/1978 | Schoppelrey | 339/157 |
| 4,117,627 | 10/1978 | Slingerland, Jr. | 47/39 |
| 4,705,483 | 11/1987 | Davis et al. | 439/502 |
| 5,150,963 | 9/1992 | Hill | 362/123 |
| 5,492,301 | 2/1996 | Hauser | 47/40.5 |

FOREIGN PATENT DOCUMENTS

| | | | |
|---|---|---|---|
| 2659214 | 9/1990 | France | 47/40.5 |
| 2667492 | 4/1992 | France | 47/39 M |
| 682971 | 12/1993 | Switzerland | 47/39 M |
| 118744 | 9/1918 | United Kingdom | 47/39 M |
| 388545 | 3/1933 | United Kingdom | 47/39 M |
| 309 | 7/1978 | United Kingdom | 47/39 M |
| 2067837 | 7/1981 | United Kingdom | 47/39 M |

*Primary Examiner*—Thomas Price
*Assistant Examiner*—Fredrick T. French, III

[57] ABSTRACT

A new Rotating Tree Stand System for providing a rotating tree stand which also provides a plurality of electrical receptacles for electrically connecting a plurality of electrical ornaments. The inventive device includes a base, an upper member rotatably connected to the base, a tree support device secured to the upper member, an electric motor mechanically connected to the upper member for rotating the upper member, and a plurality of electrical receptacles within the base and the upper member.

8 Claims, 3 Drawing Sheets

10
30
40
24
24
24
2
2
22
28
20
26

40
3
30
70
24
24
22
4
32
52
4
72
60
74
62
76
64
20
50
64
62
60
32
3

ROTATING TREE STAND SYSTEM

BACKGROUND OF THE INVENTION

1. Field of the Invention

The present invention relates to Tree Stand Devices and more particularly pertains to a new Rotating Tree Stand System for providing a rotating tree stand which also provides a plurality of electrical receptacles for electrically connecting a plurality of electrical ornaments.

2. Description of the Prior Art

The use of Tree Stand Devices is known in the prior art. More specifically, Tree Stand Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Tree Stand Devices include U.S. Pat. No. 5,150,963; U.S. Pat. No. 4,705,483; U.S. Design Pat. No. 358,673; U.S. Pat. No. 4,516,193; U.S. Pat. No. 4,099,824; and U.S. Pat. No. 5,213,519.

While these devices fulfill their respective, particular objectives and requirements, the aforementioned patents do not disclose a new Rotating Tree Stand System. The inventive device includes a base, an upper member rotatably connected to the base, a tree support device secured to the upper member, an electric motor mechanically connected to the upper member for rotating the upper member, and a plurality of electrical receptacles within the base and the upper member.

In these respects, the Rotating Tree Stand System according to the present invention substantially departs from the conventional concepts and designs of the prior art, and in so doing provides an apparatus primarily developed for the purpose of providing a rotating tree stand which also provides a plurality of electrical receptacles for electrically connecting a plurality of electrical ornaments.

SUMMARY OF THE INVENTION

In view of the foregoing disadvantages inherent in the known types of Tree Stand Devices now present in the prior art, the present invention provides a new Rotating Tree Stand System construction wherein the same can be utilized for providing a rotating tree stand which also provides a plurality of electrical receptacles for electrically connecting a plurality of electrical ornaments.

The general purpose of the present invention, which will be described subsequently in greater detail, is to provide a new Rotating Tree Stand System apparatus and method which has many of the advantages of the Tree Stand Devices mentioned heretofore and many novel features that result in a new Rotating Tree Stand System which is not anticipated, rendered obvious, suggested, or even implied by any of the prior art Tree Stand Devices, either alone or in any combination thereof.

To attain this, the present invention generally comprises a base, an upper member rotatably connected to the base, a tree support device secured to the upper member, an electric motor mechanically connected to the upper member for rotating the upper member, and a plurality of electrical receptacles within the base and the upper member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Rotating Tree Stand System apparatus and method which has many of the advantages of the Tree Stand Devices mentioned heretofore and many novel features that result in a new Rotating Tree Stand System which is not anticipated, rendered obvious, suggested, or even implied by any of the prior art Tree Stand Devices, either alone or in any combination thereof. It is another object of the present invention to provide a new Rotating Tree Stand System which may be easily and efficiently manufactured and marketed.

It is a further object of the present invention to provide a new Rotating Tree Stand System which is of a durable and reliable construction.

An even further object of the present invention is to provide a new Rotating Tree Stand System which is susceptible of a low cost of manufacture with regard to both materials and labor, and which accordingly is then susceptible of low prices of sale to the consuming public, thereby making such Rotating Tree Stand System economically available to the buying public.

Still yet another object of the present invention is to provide a new Rotating Tree Stand System which provides in the apparatuses and methods of the prior art some of the advantages thereof, while simultaneously overcoming some of the disadvantages normally associated therewith.

Still another object of the present invention is to provide a new Rotating Tree Stand System for providing a rotating tree stand which also provides a plurality of electrical receptacles for electrically connecting a plurality of electrical ornaments.

Yet another object of the present invention is to provide a new Rotating Tree Stand System which includes a base, an upper member rotatably connected to the base, a tree support device secured to the upper member, an electric motor mechanically connected to the upper member for rotating the upper member, and a plurality of electrical receptacles within the base and the upper member.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
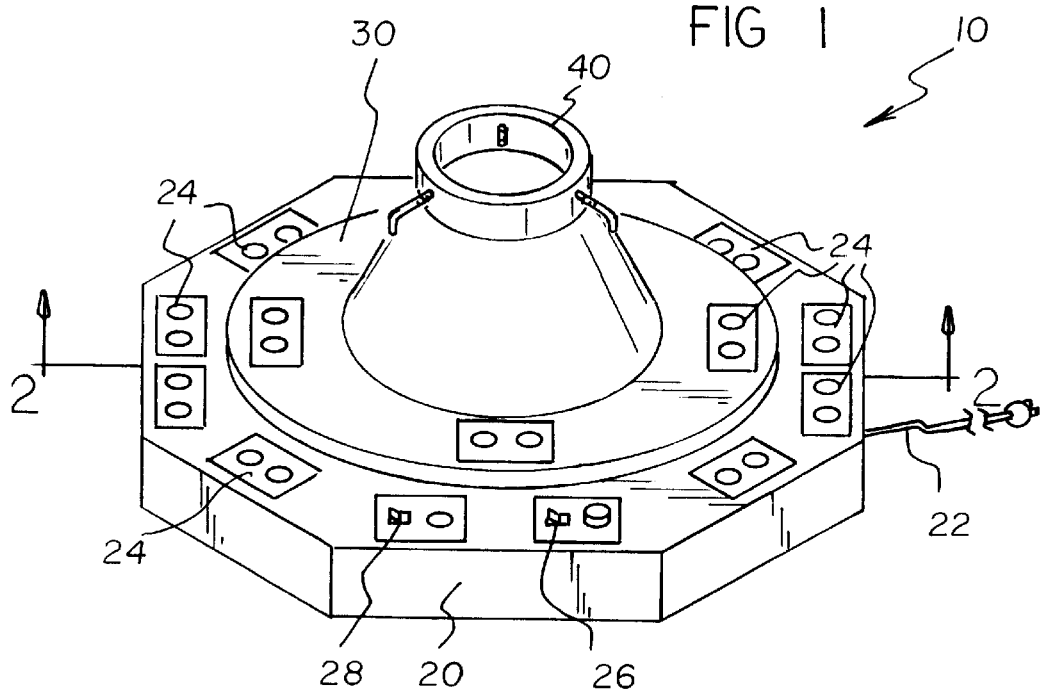
FIG. 1 is an upper perspective view of a new Rotating Tree Stand System according to the present invention.

With reference now to the drawings, and in particular to FIGS. 1 through 5 thereof, a new Rotating Tree Stand System embodying the principles and concepts of the present invention and generally designated by the reference numeral 10 will be described.

As best illustrated in FIGS. 1 through 5, the Rotating Tree Stand System 10 comprises a rotating device for rotating the Christmas tree, and a plurality of the electrical receptacles 24 secured within the rotating means for providing electrical power to the plurality of electrical ornaments.

As shown in FIGS. 1 through 5, the rotating means comprises a base 20 substantially swaged and having an interior cavity exposed through an opening within a cornice thereof An upper member 30 is rotatably positioned within the interior cavity and exposed through the opening of the base 20. A plurality of wheels 32 are attached to the upper member 30 for rotatably engaging the base 20. A tree support device 40 is secured to the upper member 30 for supporting the Christmas tree. A rotation means is secured within the interior portion of the base 20 for rotating the upper member 30 and simultaneously providing electrical power to the electrical receptacles 24 secured within the base 20 and the upper member 30.

Figure 2:
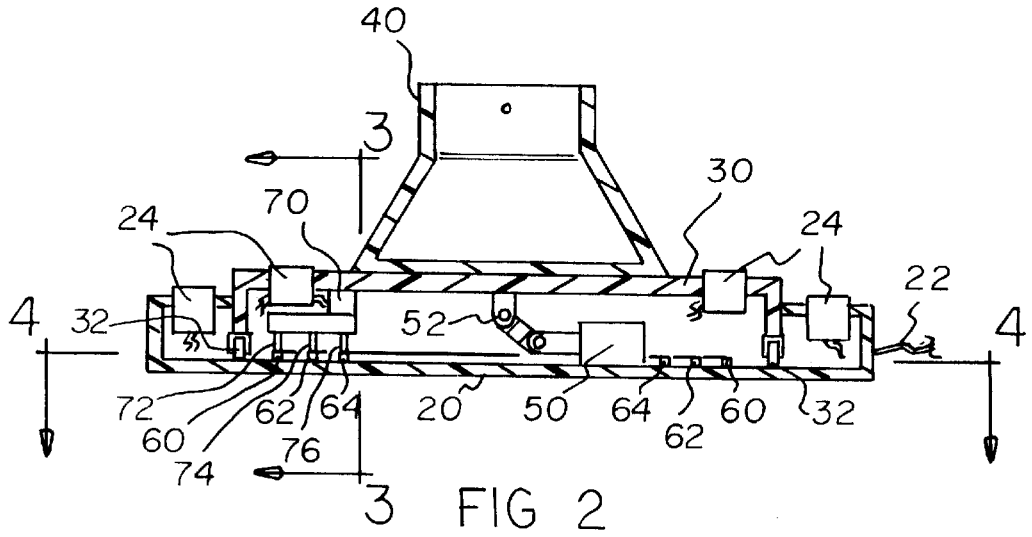
FIG. 2 is a cross sectional view taken along line 2—2 of FIG. 1.
Figure 3:
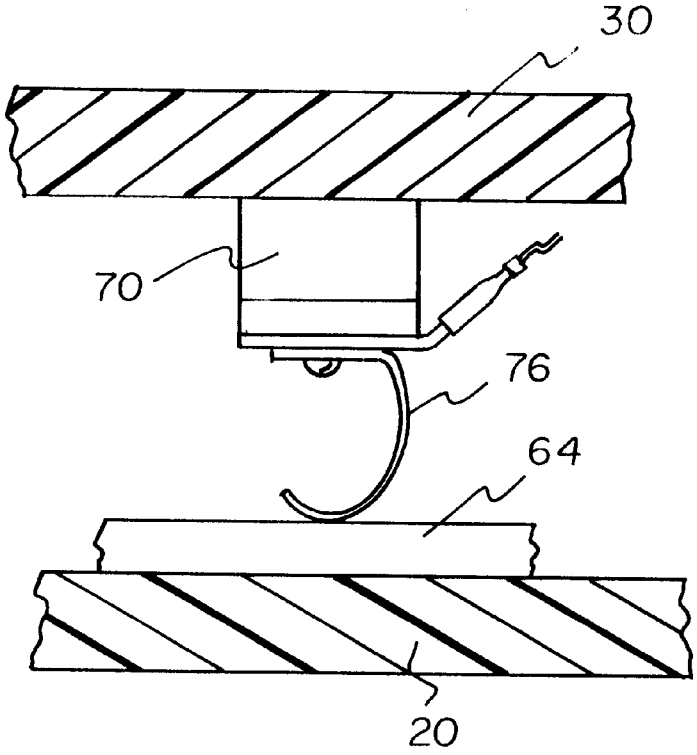
FIG. 3 is a cross sectional view taken along line 3—3 of FIG. 2.
Figure 4:
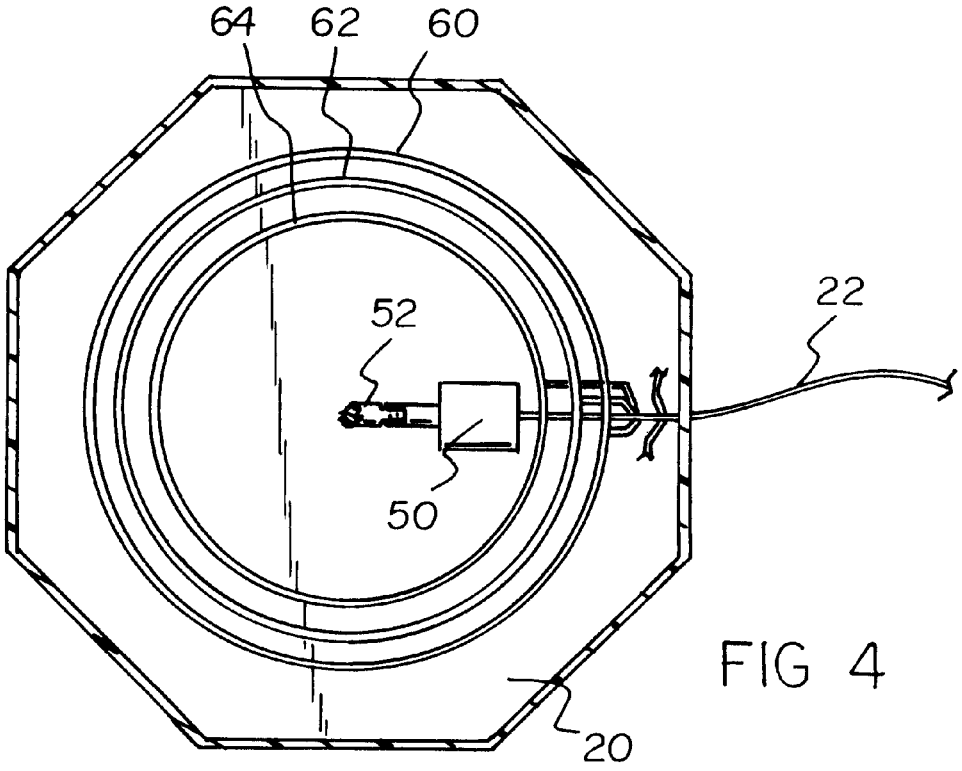
FIG. 4 is a cross sectional view taken along line 4—4 of FIG. 2.
Figure 5:
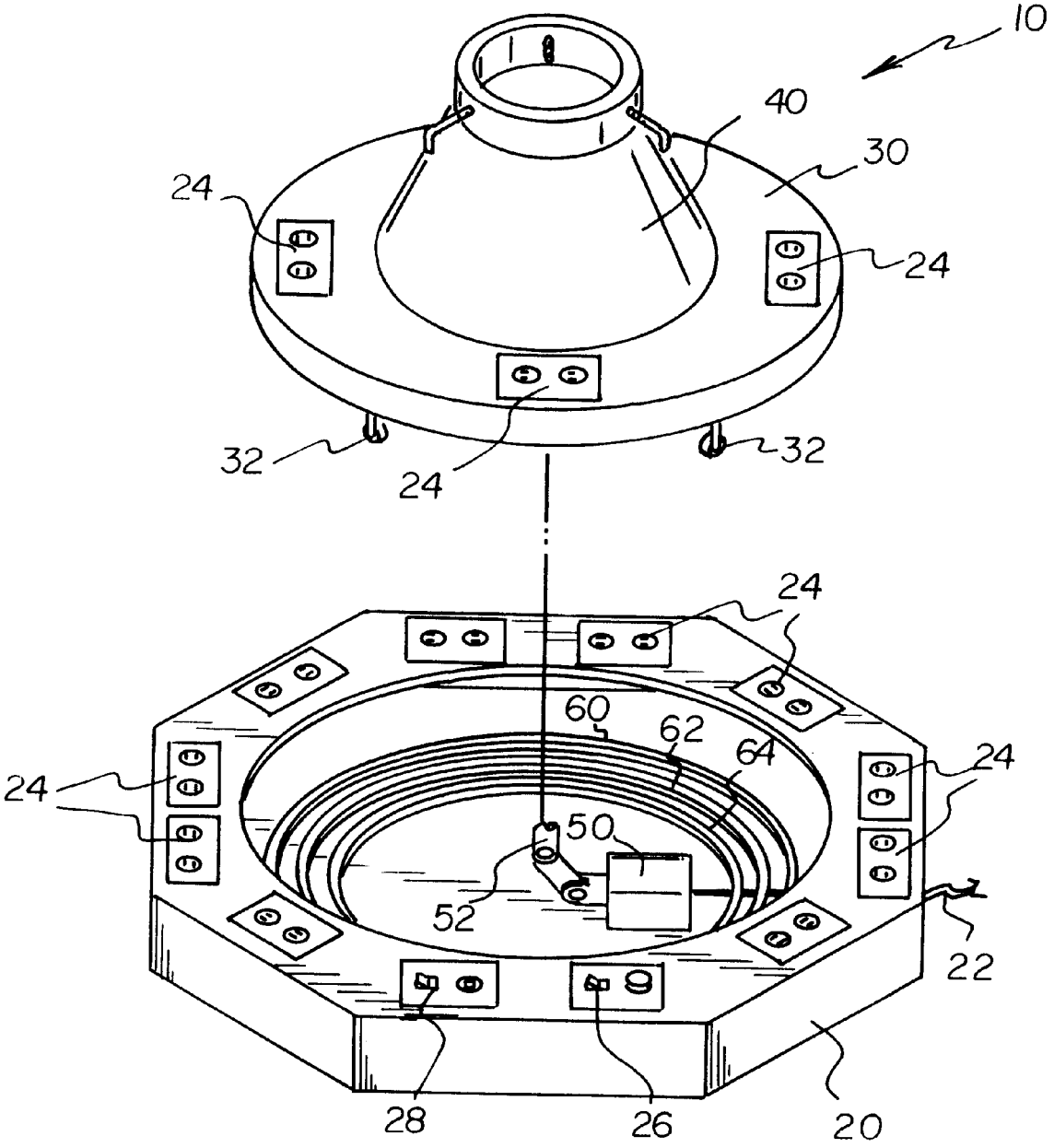
FIG. 5 is an exploded upper perspective view of the present invention.

As shown in FIGS. 2, 4 and 5 of the drawings, the rotation means comprises an electric motor 50 secured within the interior cavity of the base 20. A universal joint 52 is connected mesial the electrical motor and a concentric portion of the upper member 30 for allowing the motor to rotate the upper member 30. A neutral conductor 60, a positive conductor 62, and a negative conductor 64 are secured to a bottom surface within the interior cavity of the base 20 and are formed in circular shapes coaxial about a concentric point of the base 20 as best shown in FIG. 4 of the drawings. A junction box 70 is secured to the upper member 30 and is electrically connected to the plurality of electrical receptacles 24 within the upper member 30. A neutral brush 72, a positive brush 74, and a negative brush 76 are secured to a bottom side of the upper member 30 and are correspondingly electrically and slidably in contact with the neutral conductor 60, the positive conductor 62 and the negative conductor 64. As shown in FIG. 2 of the drawings, the brushes 72, 74 and 76 are electrically connected to the junction box 70.

As shown in FIGS. 1 and 5, an upper switch 26 is secured within the base 20 and is electrically connected to the electric motor 50 and the conductors for controlling electrical power to the electric motor 50 and the conductors 60, 62 and 64. A lower switch 28 is secured within the base 20 and is electrically connected to the plurality of electrical receptacles 24 within the base 20 conductors for controlling electrical power to the plurality of electrical receptacles 24. The upper switch 26 and the lower switch 28 are electrically connected to a power cord 22 for providing electrical power to the upper switch 26 and the lower switch 28.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A rotating tree stand system for rotating a Christmas tree and for providing a plurality of electrical receptacles for which to electrically connect a plurality of electrical ornaments, comprising:

a rotating device for rotating said Christmas tree;

wherein said rotating device comprises:

a base having an interior cavity exposed through an opening therethrough;

an upper member rotatably positioned within said interior cavity and exposed through said opening of said base; and a plurality of wheels being attached to said upper member for rotatably engaging said base; and a plurality of electrical receptacles secured within said rotating device and being adapted to provide electrical power to a plurality of electrical ornaments.

2. The rotating tree stand system of claim 1, wherein said rotating device further comprises a rotating means, said rotation means comprising:

an electric motor secured within said interior cavity of said base;

a universal joint connected mesial said electrical motor and a concentric portion of said upper member for allowing said motor to rotate said upper member;

a neutral conductor, a positive conductor, and a negative conductor secured to a bottom surface within said interior cavity of said base and formed in circular shapes coaxial about a concentric point of said base;

a junction box secured to said upper member and electrically connected to said plurality of electrical receptacles within said upper member; and a neutral brush, a positive brush, and a negative brush secured to a bottom side of said upper member and correspondingly electrically contacting said neutral conductor, said positive conductor and said negative conductor, and wherein said brushes are electrically connected to said junction box.

3. The rotating tree stand system of claim 1, including an upper switch secured within said base and electrically connected to said rotating device for controlling electrical power to said rotating device.

4. The rotating tree stand system of claim 1, including a lower switch secured within said base and electrically connected to said plurality of electrical receptacles within said base conductors for controlling electrical power to said plurality of electrical receptacles.

5. A rotating tree stand system for rotating a Christmas tree and for providing a plurality of electrical receptacles for which to electrically connect a plurality of electrical ornaments, comprising:

a rotating device for rotating said Christmas tree;

said rotating device having a base substantially swaged and having an interior cavity exposed through an opening within a cornice thereof;

said rotating device having an upper member rotatably positioned within said interior cavity and exposed through said opening of said base;

said rotating device having a plurality of wheels are attached to said upper member for rotatably engaging said base;

said rotating device having a tree support device secured to said upper member for supporting said Christmas tree; and said rotating device having a rotation means secured within said interior portion of said base for rotating said upper member and simultaneously providing electrical power to said electrical receptacles secured within said base and said upper member; and a plurality of electrical receptacles secured within said rotating device and being adapted to provide electrical power to a plurality of electrical ornaments.

6. The rotating tree stand system of claim 5, wherein said rotation means comprises:

an electric motor secured within said interior cavity of said base;

a universal joint connected mesial said electrical motor and a concentric portion of said upper member for allowing said motor to rotate said upper member;

a neutral conductor, a positive conductor, and a negative conductor secured to a bottom surface within said interior cavity of said base and formed in circular shapes coaxial about a concentric point of said base;

a junction box secured to said upper member and electrically connected to said plurality of electrical receptacles within said upper member; and a neutral brush, a positive brush, and a negative brush secured to a bottom side of said upper member and correspondingly electrically contacting said neutral conductor, said positive conductor and said negative conductor, and wherein said brushes are electrically connected to said junction box.

7. The rotating tree stand system of claim 6, including an upper switch secured within said base and electrically connected to said electric motor and said conductors for controlling electrical power to said electric motor and said conductors.

8. The rotating tree stand system of claim 6, including a lower switch secured within said base and electrically connected to said plurality of electrical receptacles within said base conductors for controlling electrical power to said plurality of electrical receptacles.

* * * * *